United States Patent [19]

Furukawa

[11] Patent Number: 5,009,060

[45] Date of Patent: Apr. 23, 1991

[54] VACUUM PACKAGING APPARATUS

[75] Inventor: Takao Furukawa, Onomichi, Japan

[73] Assignees: ECS Corporation; Furukawa Mfg., Co., Ltd., both of Japan

[21] Appl. No.: 390,416

[22] Filed: Aug. 7, 1989

[30] Foreign Application Priority Data

Mar. 31, 1989 [JP] Japan ..... 1-83096

[51] Int. Cl.[5] ..... B65B 31/02; B65B 43/30

[52] U.S. Cl. ..... 53/512; 53/86; 53/386.1; 53/570

[58] Field of Search ..... 53/86, 91, 95, 276, 53/373, 386, 434, 510, 511, 512, 570

[56] References Cited

U.S. PATENT DOCUMENTS

| | | | |
|---|---|---|---|
| 2,281,516 | 4/1942 | Royal | 53/386 |
| 3,381,447 | 5/1968 | Ash et al. | 53/386 |
| 3,626,662 | 12/1971 | Gravely | 53/386 X |
| 3,910,009 | 10/1975 | Ganfield | 53/95 X |
| 4,546,592 | 10/1985 | Reil | 53/373 |
| 4,580,393 | 4/1986 | Furukawa | 53/512 |
| 4,586,320 | 5/1986 | Takai et al. | 53/512 |
| 4,706,441 | 11/1987 | Chervalier | 53/512 |
| 4,723,392 | 2/1988 | Takeda | 53/512 X |
| 4,845,927 | 7/1989 | Rapparini | 53/511 |

*Primary Examiner*—John Sipos
*Assistant Examiner*—Beth Bianca
*Attorney, Agent, or Firm*—Barnes, Kisselle, Raisch, Choate, Whittemore and Hulbert

[57] ABSTRACT

A vacuum packaging apparatus suitable for use in packing fluid foodstuffs or the like into bags. In a chamber are disposed a pair of support members having surfaces opposite relative to each other which are individually formed with suction holes. When a bag is fed between the pair of support members, vacuum is applied through the suction holes so that opposite surfaces of the bag are sucked into the opposite surfaces of the support members. Subsequently, the support members are moved away from each other, whereupon the mouth of the bag is opened. An object is fed into the mouth-opened bag for being vacuum packed therein. The resulting vacuum packaged product is supported in position between the pair of support members, being thereby flatly shaped.

13 Claims, 9 Drawing Sheets

VACUUM PACKAGING APPARATUS

FIELD OF THE INVENTION

The present invention relates to a vacuum packaging apparatus suitable for use in flatly packaging a fluid foodstuff, such as ground fish meat, into bags.

BACKGROUND OF THE INVENTION

When packaging such fluid type of foodstuff into bags, the trouble which is usually encountered is that the foodstuff is liable to flow out of the bag if the bag happens to be slightly tilted. One attempt directed to preventing such a trouble is that, as described in U.S. Pat. No. 4,580,393, when vacuum packaging a foodstuff of such sort, a predetermined quantity of such foodstuff is fed into each bag while the bag is supported in suspension by clippers, and then the bag is delivered into a vacuum chamber as it is held in suspension by the clippers.

Such clippers are similar in construction to clothespegs, being such that a packaging bag is supplied into a narrow space defined between a pair of clippers in opened condition. With such clippers, however, the trouble is that since a flexible packaging bag has an inherent distortion, it is impracticable to expect that packaging bags can be fed with 100% accuracy to individual pairs of clippers during bag feed operation, it being thus likely that some clipping errors will take place. Once each bag is clipped in position by a pair of clippers, it is then required that opposite sides of the bag be sucked into a vacuum cup to thereby open the mounth of the bag through which foodstuff is to be placed as required. In this case, even if the bag is accurately clipped in position by the clippers, the vacuum cup operates to open the mouth of the bag immediately after it goes in momentary contact with the bag, for purposes of increasing the efficiency of packaging operation, with the result that the pressure in the interior of the bag becomes negative so that the bag is likely to get disengaged from the vacuum cup. Furthermore, since the foodstuff tends to set in spherical form at the bottom of the bag under its own weight as it is loaded into the bag, it is likely that the foodstuff will be vacuum packaged as it remains in spherical form in the bag.

In U.S. Pat. No. 3,488,914, a vacuum packaging apparatus is disclosed in which belt-like strips of film are delivered as they are gradually rounded into tubular form, and the tubulated pieces of film are cross-sealed to a predetermined length and successively formed into bags, the bags being filled with a fluid foodstuff which are in turn dropped successively into a vacuum chamber for vacuum packaging. This apparatus eliminates the necessity of each bag being grasped in position by clippers and the use of a vacuum cup for opening the mouth of the bag, and therefore it permits packaging operation with less error possibility. However, the apparatus has a disadvantage in that since belt-like strips of film are rounded to form bags, each bag has an overlapped film edge portion formed centrally therein, so that when the tubulated film is cross-sealed at opposite ends, the bag has portions different in thickness from its center overlapped portion, which often results in unsatisfactory sealing. As such, the apparatus has not proved successful for use in vacuum packaging operation.

SUMMARY OF THE INVENTION

The present invention is directed to overcoming the foregoing problems with the prior art, and accordingly it is a primary object of the invention to provide an apparatus for vacuum packaging a fluid object by using bags formed of an extruded plastic tube material and having no overlapped center portion and with less operation error possibility involved.

In order to accomplish this object, in accordance with the invention an apparatus for vacuum packaging an object into bags is provided which comprises:

- chambers movable along an endless track and into which said bags are to be supplied,
- a pair of support means disposed in each of said chambers and movable toward and away from each other and which have opposed faces large enough to grasp therebetween a larger part of one of the bags as the bag is supplied into the chamber,
- suction holes formed in plurality on said opposed faces of said pair of support means,
- suction means for causing a vacuum force of suction to be applied through said suction holes to opposite sides of the bag adjacent the mouth thereof to thereby cause said opposite sides to be sucked onto said pair of support means as moved toward each other,
- means for separating said pair of support means from each other, when the bag is held between then under suction, to thereby open the mouth of the bag,
- means for loading the to-be-packaged object into the bag when the mouth thereof is opened,
- means for closing the chamber when the bag is filled with said object,
- means for vacuumizing the chamber when closed,
- means for heat sealing the mouth of the bag under vacuum, and
- means for discharging a vacuum packaged product from the chamber after the mouth of the bag having been heat sealed.

According to such arrangement, when each chamber, which travels a predetermined distance at intermitent intervals along the endless track, stops at a position for getting bag supply, a bag held on a multi-hole spatula, for example, under vacuum is delivered into the chamber, and the bag is inflated by compressed air jetting through the multi-hole spatula. Simultaneously, by a vacuum force of suction produced in a multiplicity of suction holes formed on opposed faces of the pair of support means disposed in the chamber, opposite surfaces of the bag are sucked onto the opposed faces of the support means and the bag is outstretched as the two support means are moved away from each other. Subsequently, when an object is loaded into the bag, vacuum is applied to the interior of the chamber and the two support means are moved toward each other to exert pressure on the bag from opposite sides, the object being thus shaped to a flat plate configuration. The vacuum packaged product thus obtained is discharged from the chamber.

Therefore, bags can be supported in position within individual chambers without using such clothespeg-type clippers as have been conventionally used, possible bag holding errors being thus eliminated. Further, the necessity of feeding a bag into a narrow space defined between a pair of clippers in opened condition that has been usual in the case where such clippers are used is eliminated. This assures improved efficiency of bag opening operation in each chamber and provides good solution to the trouble of objects, such as foodstuffs, being fed to bags with their mouths still left in closed state. Objects can be vacuum packed into bags in such a manner that each bag is supported at opposite sides by the pair of support means, it being thus possible to obtain a flatly shaped vacuum packaged product.

DESCRIPTION OF THE PREFERRED EMBODIMENTS

Figure 1:
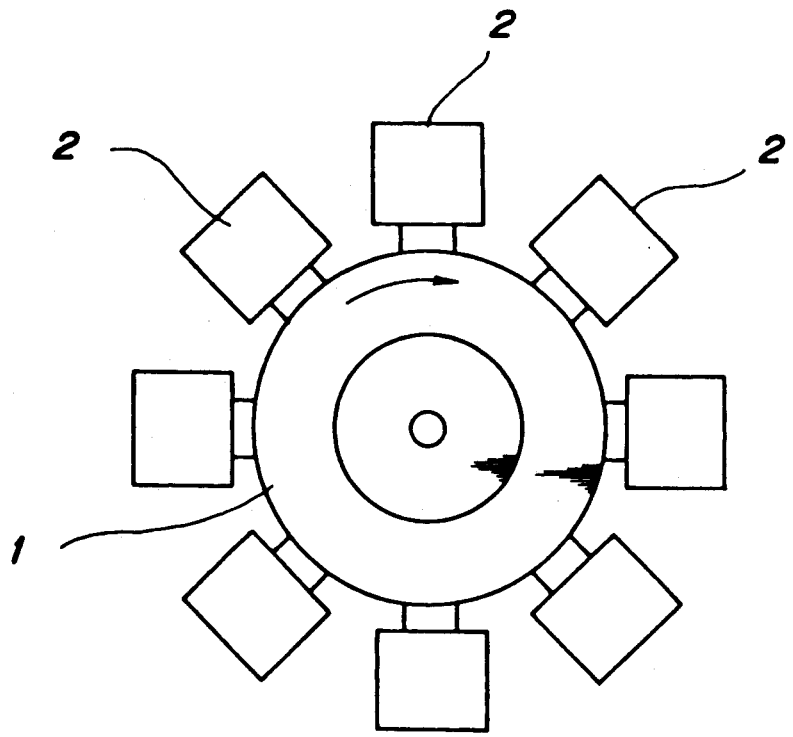
FIG. 1 is a schematic plan view of a vacuum packaging apparatus representing one embodiment of the invention.

FIG. 1 schematically shows a rotary vacuum packaging apparatus according to the present invention. This vacuum packaging apparatus includes a turntable 1, and eight vacuum chambers 2, 2 . . . mounted at 45 degree intervals around the turntable 1. The turntable 1 and individual chambers 2, 2 . . . are adapted to intermittently move at 45 degree intervals in the clockwise direction in FIG. 1.

Figure 2:
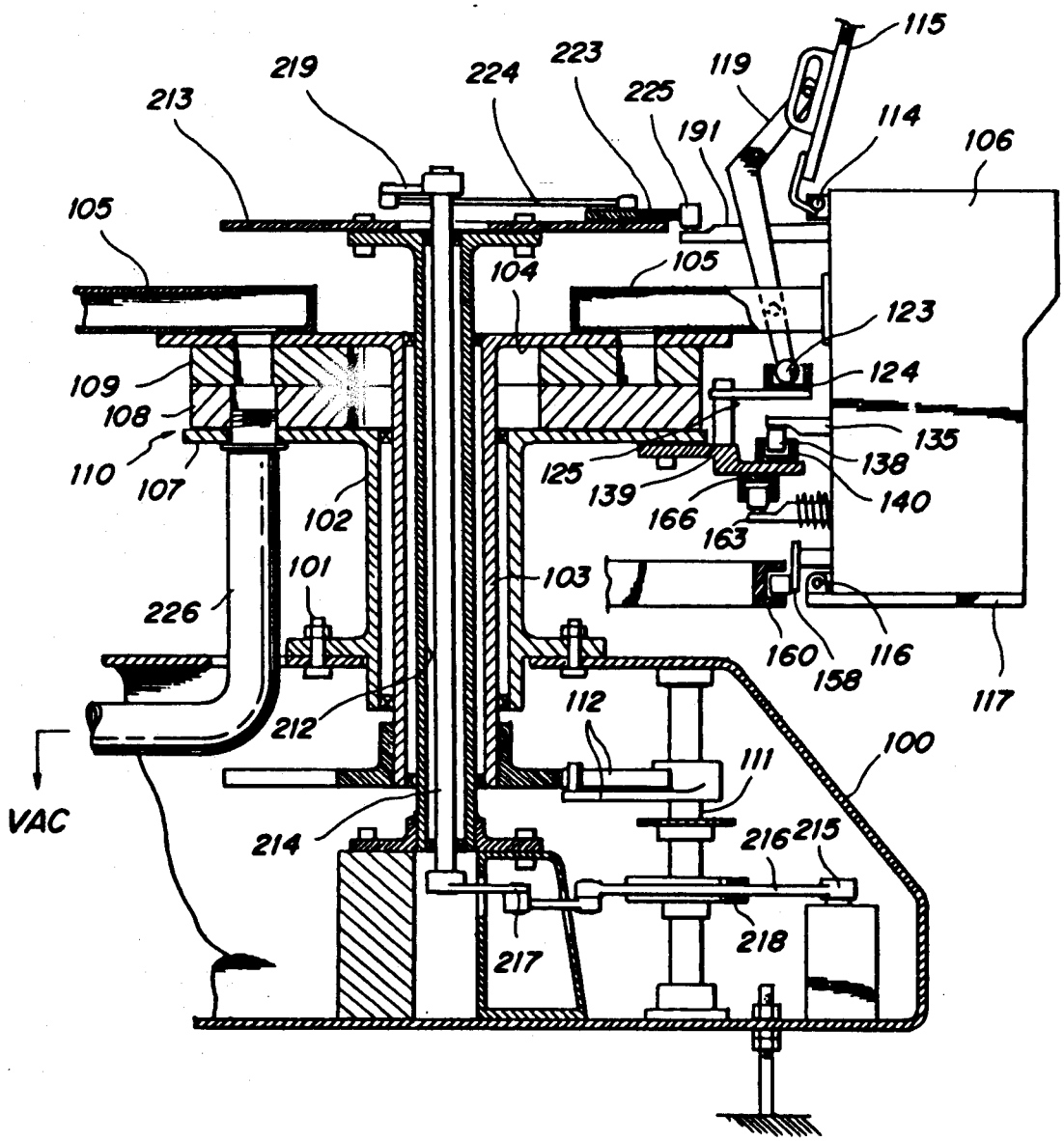
FIG. 2 is a sectional view showing the vacuum packaging apparatus of FIG. 1.

FIGS. 2 through 13, inclusive, illustrate detailed aspects of the vacuum packaging apparatus. In FIG. 2, a verical pipe-shaped main shaft 103 is rotatably supported in a bearing 102 fixed by bolts and nuts 101 to the top of a machine frame 100, and eight arms 105, 105 . . . are radially disposed on a disc-shaped rotor 104 mounted on the top of the main shaft 103, with chambers 106, . . . individually fixed to the front ends of the arms. A rotary valve 110 comprises an annular disc shaped member 108 fixed in position on an top end flange 107 of the bearing 102, and another annular disc shaped member 109 fixed to the underside of the rotor 104. A driving shaft 111 disposed in the machine frame is connected through a Geneva stop 112 with the lower end of the main shaft 103 so that the rotating power of the driving shaft 111 is transmitted to the main shaft 103 through the Geneva stop 112, whereby the two component members 108, 109 of the rotary valve are caused to slide relative to each other to permit intermittent rotation of the rotor 104 at 45 degree intervals in integral relation with individual chambers 106, . . . .

Figure 3:
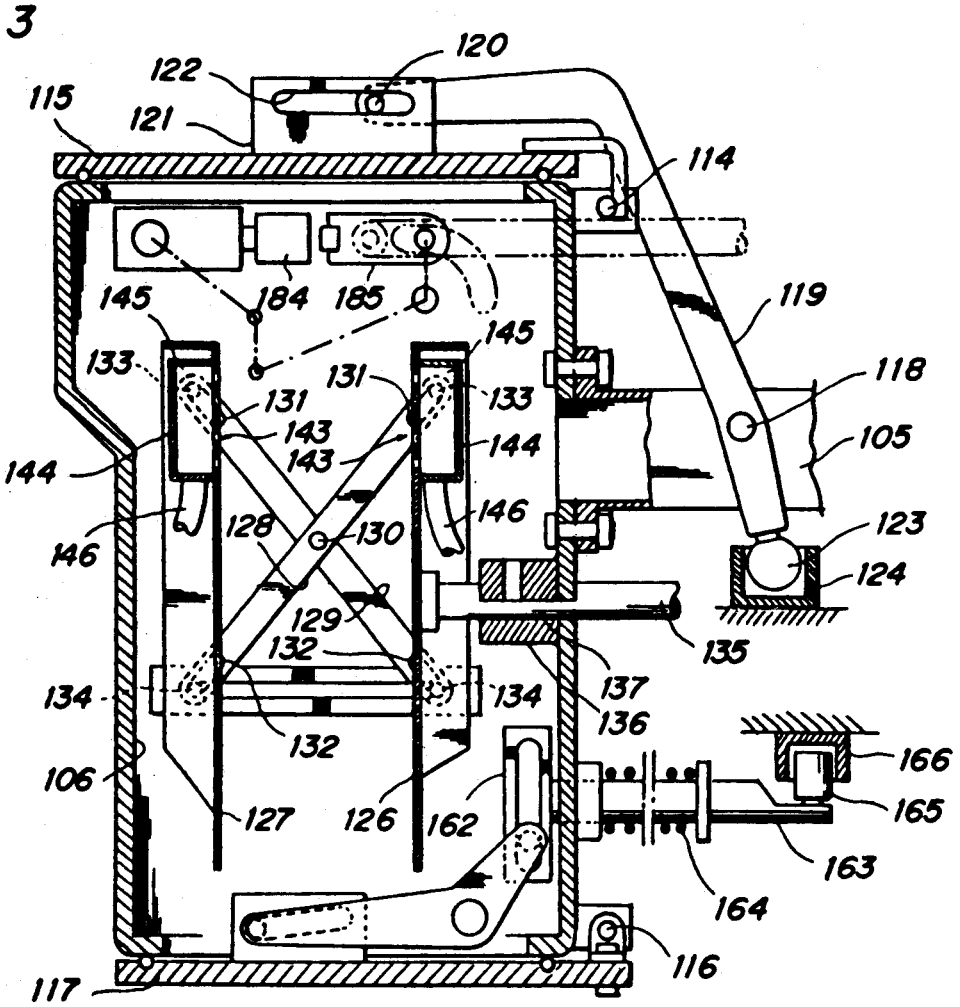
FIG. 3 is a sectional view as seen in side elevation of the internal arrangement of a chamber in FIG. 2.

FIG. 3 shows the internal arrangement of each chamber 106 in detail. The chamber 106 is equipped at its top opening portion with a lid 115 free to be opened and closed about a pin 114, and at its lower opening portion with a bottom plate 117 free to be opened and closed about a pin 116. A pin 120 projecting laterally from the top end of a lever 119 supported by each arm 105 through a support shaft 118 is in engagement with an elongate slot 122 formed on a piece 121 provided on the upper surface of the lid 115, and a ball-shaped roller 123 rotatably supported at the lower end of the lever 119 is in engagement with a groove shaped cam 124. As FIG. 2 shows, the cam 124 is fixed to the machine frame 100 through a member 125, so that as the chamber 106 rotates integrally with the rotor 104, the ball shaped roller 123 shifts along the groove shaped cam 124. Accordingly, because of the movement of the cam 124 in a zigzag direction, the lid 115 is released from the chamber 106 only as required. Further, as FIG. 3 shows, a pair of support plates 126, 127 are disposed in face-to-face relation within each chamber 106.

Figure 4:
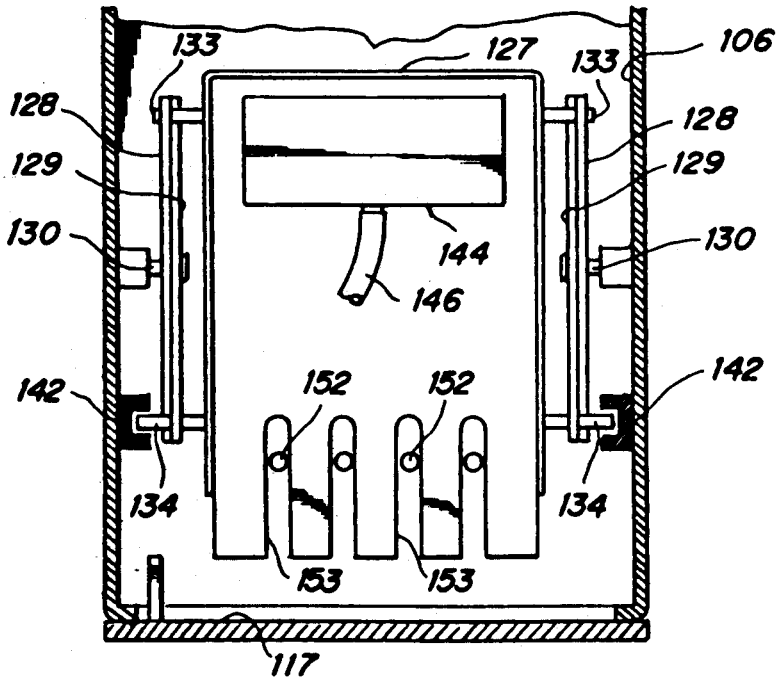
FIG. 4 is a sectional view as seen in front elevation of the interior of the chamber.

As FIG. 4 shows, two links 128, 129 each are disposed on both sides of the support plates 126, 127, which plates are supported in the chamber 106 through these links 128, 129. The two links 128, 129, which cross each other, are supported at their center portion in the chamber 106 through a pivotal shaft 130. As FIG. 3 shows, these links 128, 129 are formed at their respective both ends with elongate slots 131, 131; 132, 132 which are respectively engaged by pins 133, 134; 133, 134 so that the support plates 126, 127 are supported by the links 128, 129. A rod 135 fixed to the one support plate 126 extends through a center bore 137 of a support block 136 and outwardly of the chamber 106.

As FIG. 2 shows, a roller 138 rotatably supported on the rod 135 at its end is in engagement with a cam 140 fixed to a member 139, so that as the chamber 106 rotates integrally with the rotor 104, the rod 135 is pushed or pulled through the movement of the cam 140 in a zigzag direction. In FIG. 3, therefore, the one support plate 126 is moved by the rod 135 to thereby rotate the links 128, 129 about the pivotal shaft 130, and thus the other support plate 127 is moved correspondingly. Consequently, the two support plates 126, 127 are moved toward and away from each other in symmetrical relation. As FIG. 4 shows, the pins 134, 134 of the links 129, 129 are supported on guide rails 142, 142 so that the two support plates 126, 127 are displaced along the guide rails 142, 142.

Multiplicities of air suction holes 143, 143, . . . are formed on the opposed upper surfaces of the support plates 126, 127, and small compartments 145, 145 are defined by members 144, 144 at the rear sides of the suction holes 143. A vacuum suction force is introduced through tubes 146, 146 into the compartments so as to allow vacuum suction of packaging bags by the suction holes 143, 143. Therefore, when the two support plates 126, 127 are first moved toward each other and then moved away from each other, the mouth of a bag present therebetween can be opened wide.

Figure 5:
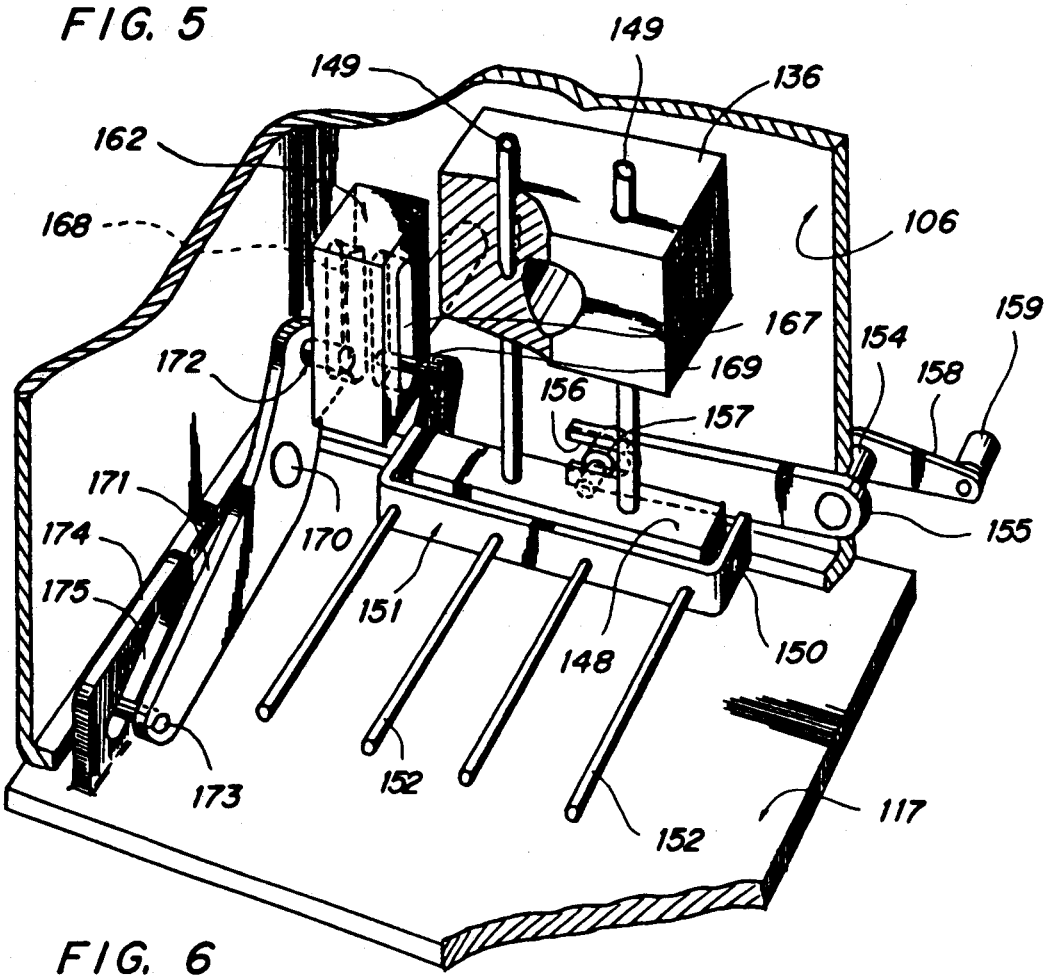
FIG. 5 is a perspective view showing the interior of the chamber.
Figure 6:
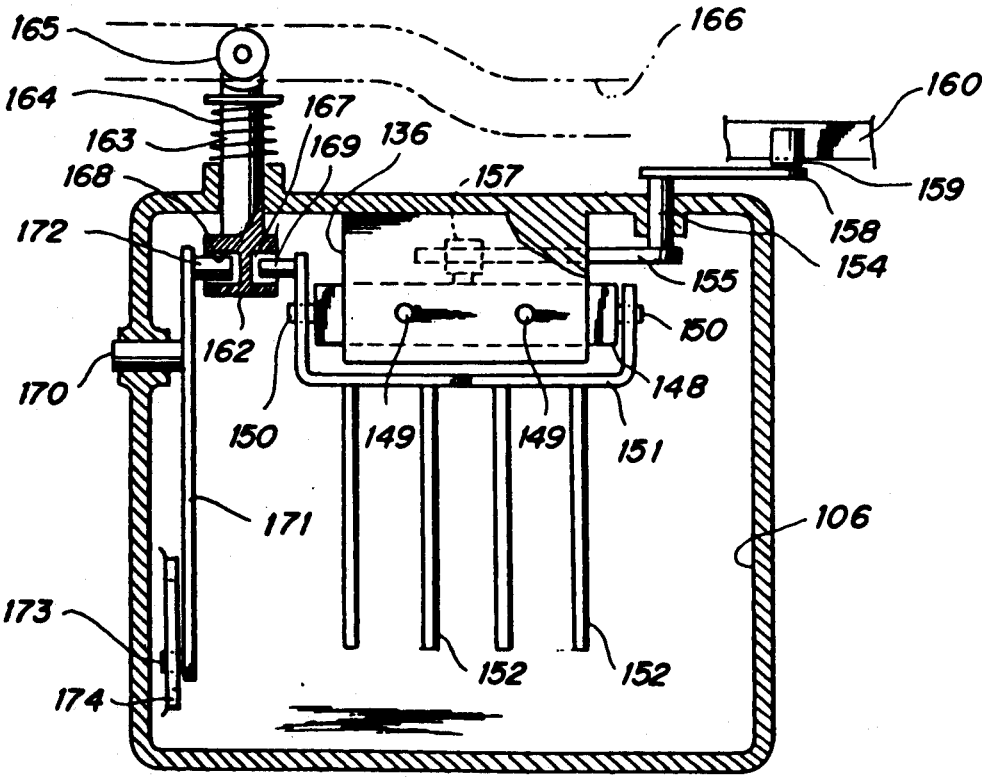
FIG. 6 is a plan view showing a bottom portion of the interior of the chamber.

As can be seen from FIGS. 5 and 6, an oblong lift member 148 is provided in each chamber 106, and two rods 149, 149 extending upwardly from the top of the lift member 148 extend vertically slidably through the support block 136. At opposite ends of the lift member 148 are formed pins 150, 150 on which are vertically rotatably supported a frame 151, with four parallel support rods 152, 152, 152, 152 fixed to the frame 151 at the front side thereof. As FIG. 4 shows, the rods 152, 152, 152, 152 are arranged in gaps 153, 153, 153, 153 provided at lower edges of the support plates 126, 127. A link 155 is fixed to the inner end of a pin 154 extending rotatably through a rear wall of the chamber 106, and a pin 157 provided at the rear side of the lift member 148 is in engagement with a slit 156 formed at the front end of the link 155, while a roller 159 provided at the end of a lever 158 fixed to the outer end of the pin 154 is in engagement with an annular cam 160.

As FIG. 2 shows, the cam 160 is annularly and horizontally configured around the rotor 104 and is engaged by the end of the lever 158, so that the four support rods 152 are constantly held at a predetermined level. When the cam 160 in its entirety is moved upward or downward for adjustment, as FIG. 5 shows, the link 155 is turned upward or downward by the lever 158 so that the lift member 148 is shifted vertically, the level of the four support rods 152 being thus adjusted. As FIG. 17 illustrates, this level adjustment is carried out according to the need for varying the setting position of the support rods 152 correspondingly to the length of a bag 300, from its mouth edge to its bottom, supported by the support rods 152.

Figure 20:
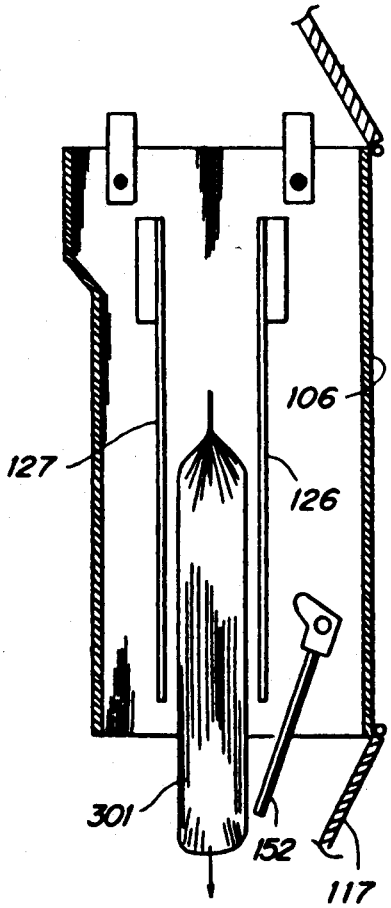

A rod 163 extends through the rear wall of each chamber 106, and a guide block 162 is fixed to the rod 163 in the chamber 106. The rod 163 is urged outward of the chamber 106 by a spring 164 and has a roller 165 provided at its front end. The roller 165 is in engagement with a cam groove 166. As FIGS. 5 and 6 show, the guide block 162 is formed at its opposite sides with longitudinally extending guide grooves 167, 168, of which one groove 167 is engaged by a pin 169 mounted at one end of the frame 151. A lever 171 is rotatably supported through a pin 170 at one side of the chamber 106. A pin 172 which is provided at one end of the lever 171 is in engagement with the other guide groove 168. A pin 173 disposed at the front end of the lever 171 is in engagement with an elongate hole 175 of a bracket 174 provided on the bottom plate 117. Since the rod 163 is in engagement with the annular cam groove 166 running along the periphery of the rotary valve 110, the rod 163 is pulled outward by means of the cam groove 166 to thereby hold the bottom plate 117 in its closed position. On the other hand, however, when the annular cam groove 166 in FIG. 2 expands radially outwardly, the bottom plate 117 rotates about the pin 116 under its own weight to open the bottom of the chamber 106, and simultaneously the four support rods 152 turn downward. In this way, as FIG. 20 shows, the support rods 152 and bottom plate 117 rotate simultaneously to permit a packaged product 301 to be discharged downward.

Figure 14:
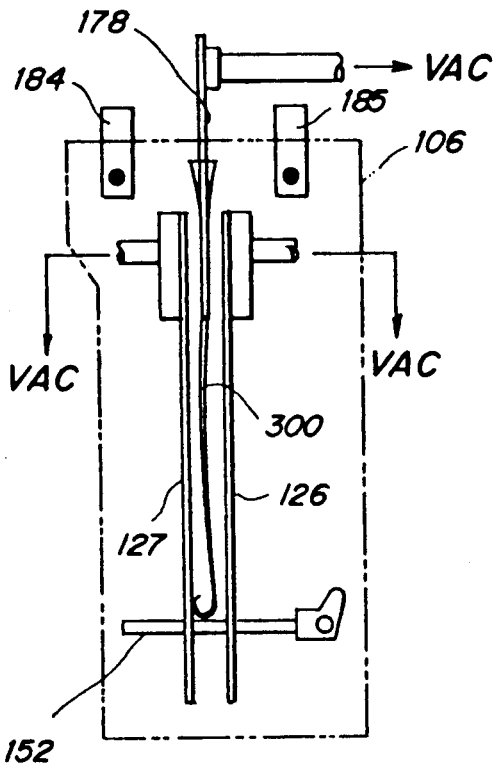
FIGS. 14 through 20, inclusive, are views for explanation of the sequence of a packaging operation.
Figure 15:
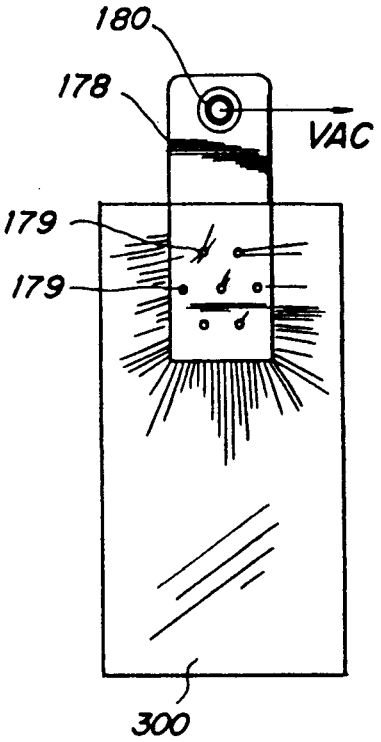
Figure 16:
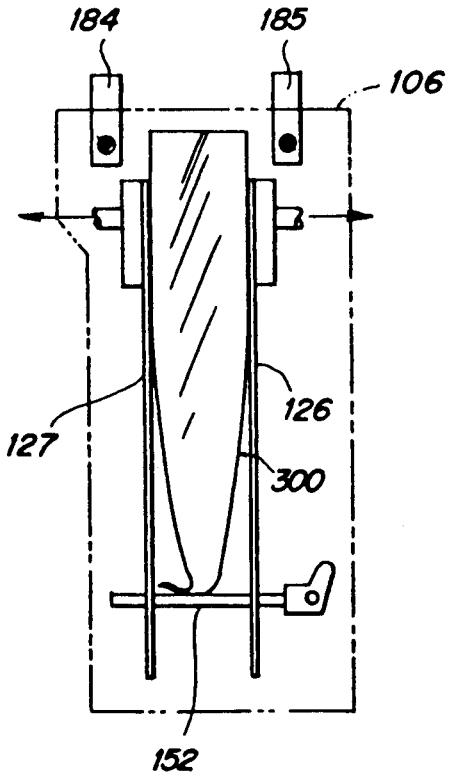

When each chamber 106 which travels round a circular track shown in FIG. 1 at intermittent intervals is caused to stop at a predetermined position, a bag 300 is fed into the space between the two support plates 126, 127 from a level above the chamber 106 as FIG. 14 shows. In this case, a particular type of spatula 178 is used for supply of bags 300. This spatula 178 is of a hollow construction and, as FIG. 15 shows, has a multiplicity of suction holes 179, 179 . . . formed on its surface and also has a hole 180 connecting with a vacuum pump. As the spatula 178 is inserted into the bag 300, the bag is sucked onto the spatula 178 so that the bag 300 can be fed in integral relation with the spatula 178 into the chamber 106. The support plates 126, 127 are moved toward opposite surfaces of the bag 300 and then they are moved away from each other, whereupon as FIG. 16 shows the bag is sucked onto the support plates 126, 127, its mouth being thus opened.

Figure 17:
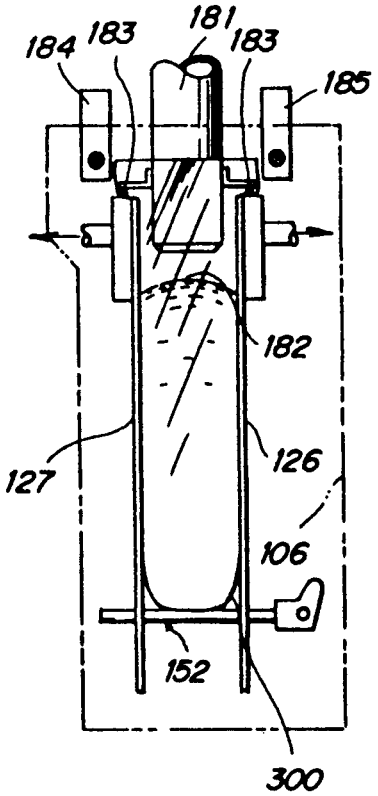

When the chamber 106 is moved again until it stops at a next stop position, as FIG. 17 shows, a nozzle 181 is inserted into the bag 300 and an object 182 is loaded into the bag through the nozzle 181. In this case, angles 183, 183 disposed on the outer periphery of the nozzle 181 operate to press the mouth edge of the bag 300 against the upper surface of the support plates 126, 127, and accordingly the bag 300 is prevented from slipping downward under the weight of the object loaded thereinto. The support rods 152 also support the bottom of the bag 300.

Figure 7:
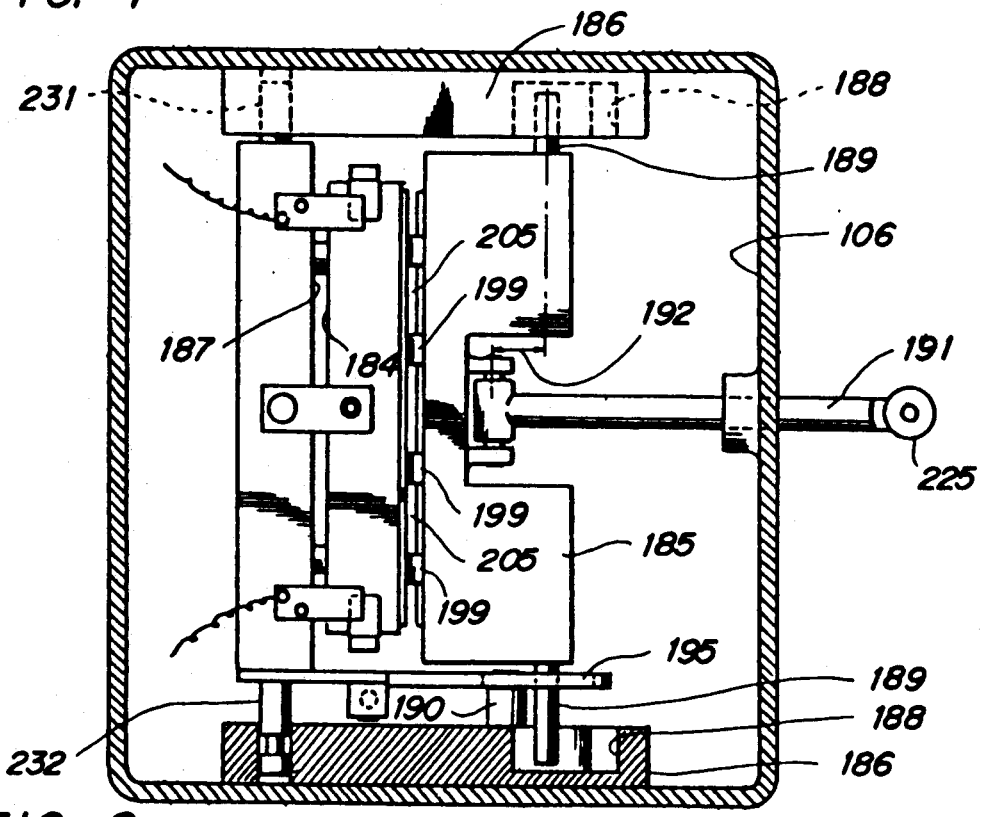
FIGS. 7 and 8 are plan views showing different aspects of an upper portion of the chamber interior.

A seal bar 184 and a seal pad 185 which are disposed at the entrance of the chamber 106 are usually spaced substantially from each other not to interfere with the movement of the nozzle 181 to be inserted into the bag 181, being moved toward each other as required. More specifically, as FIG. 7 shows, a base 187 is rotatably supported between a pair of blocks 186, 186 fixed to the interior of the chamber 106, the seal bar 184 being supported on the base 187. In turn, pins 189, 189 disposed at both ends of the seal pad 185 are in engagement with grooves 188, 188 formed in the blocks 186, 186.

Figure 8:
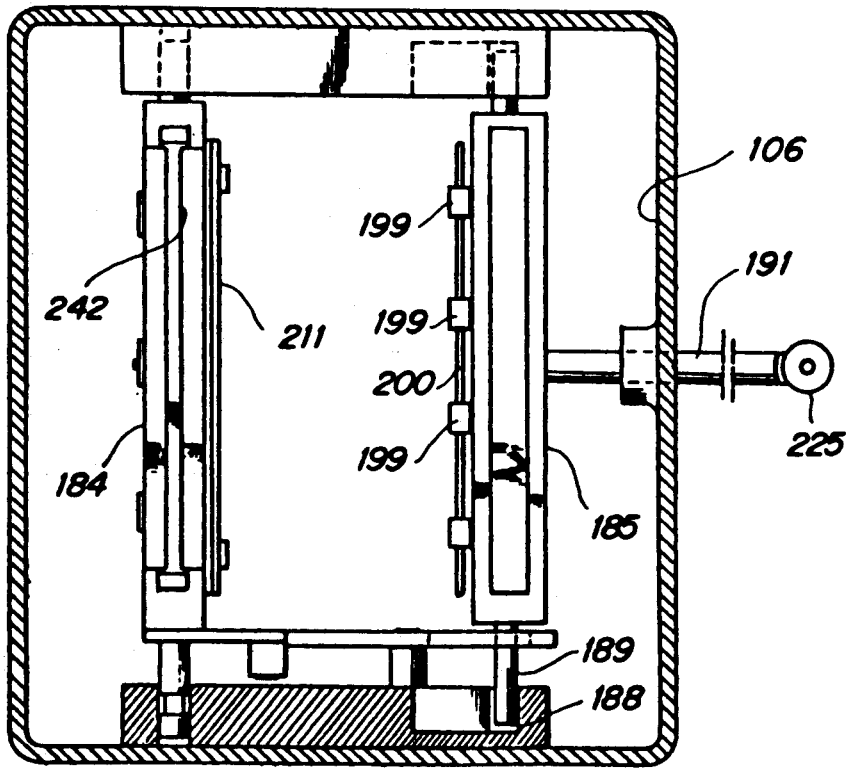
Figure 9:
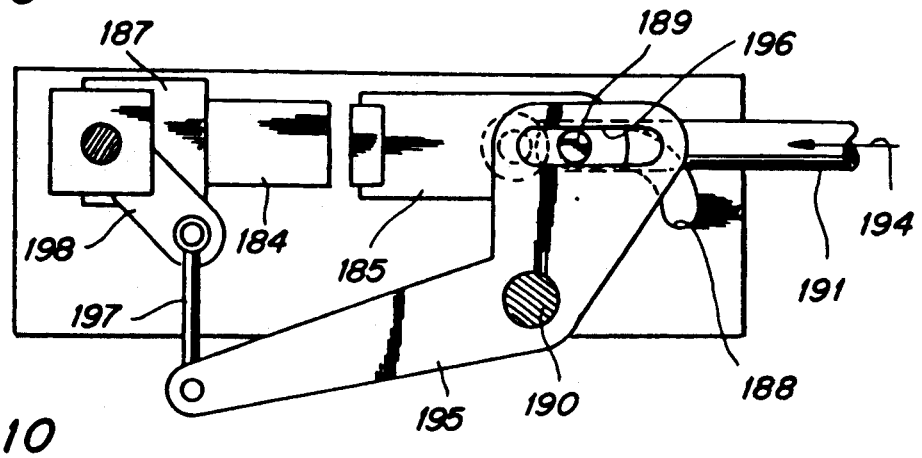
FIGS. 9 and 10 are side views showing a seal mechanism provided in the chamber.
Figure 10:
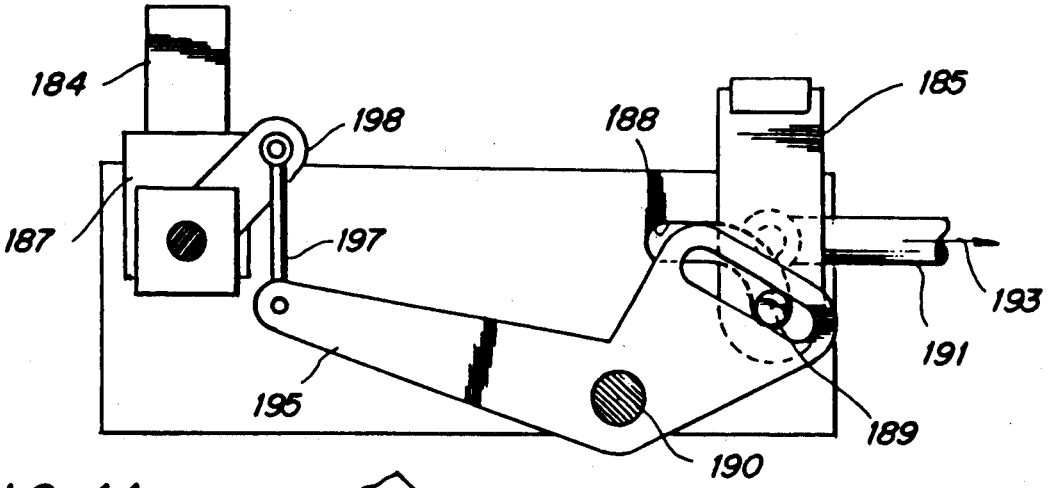

As FIG. 9 shows, each groove 188 is formed on an arcuate line contoured about a pivotal shaft 190. The seal pad 185 travels along the arcuated groove 188 through the manipulation of a rod 191 connected to the seal pad 185. A gap 192 exists between the center line of the mounting shaft of the rod 191 and that of the pin 189 as FIG. 7 shows. Therefore, as FIG. 10 shows, when the rod 191 is pulled in the direction of arrow 193, the pin 189 shifts along the groove 188 and accordingly the seal pad 185 rises to position. Conversely, if the rod 191 is pushed in the direction of arrow 194 as FIG. 9 shows, the seal pad 185 falls horizontally. Mounted on the pivot shaft 190 is a crank bar 195 having a straight elongate slot 196 formed at one end thereof, which slot 196 is engaged by the pin 189, the other end of the crank bar 195 being connected with a lever 198 mounted to the base 187 through a link 197. As FIG. 10 shows, therefore, when the pin 189 is moved along the arcuate groove 188, the crank bar 195 is rotated by the pin 189, which rotation movement is transmitted to both the link 197 and the lever 198, so that the seal pad 185 and the seal bar 184 are caused to rise up simultaneously. Conversely, when the seal pad 185 falls as FIG. 9 shows, the seal bar 184 is also horizontally laid down. FIG. 7 shows the seal pad 185 and seal bar 184 as horizontally laid down, and FIG. 8 shows the seal pad 185 and seal bar 184 as viewed in their rise-up position.

Figure 11:
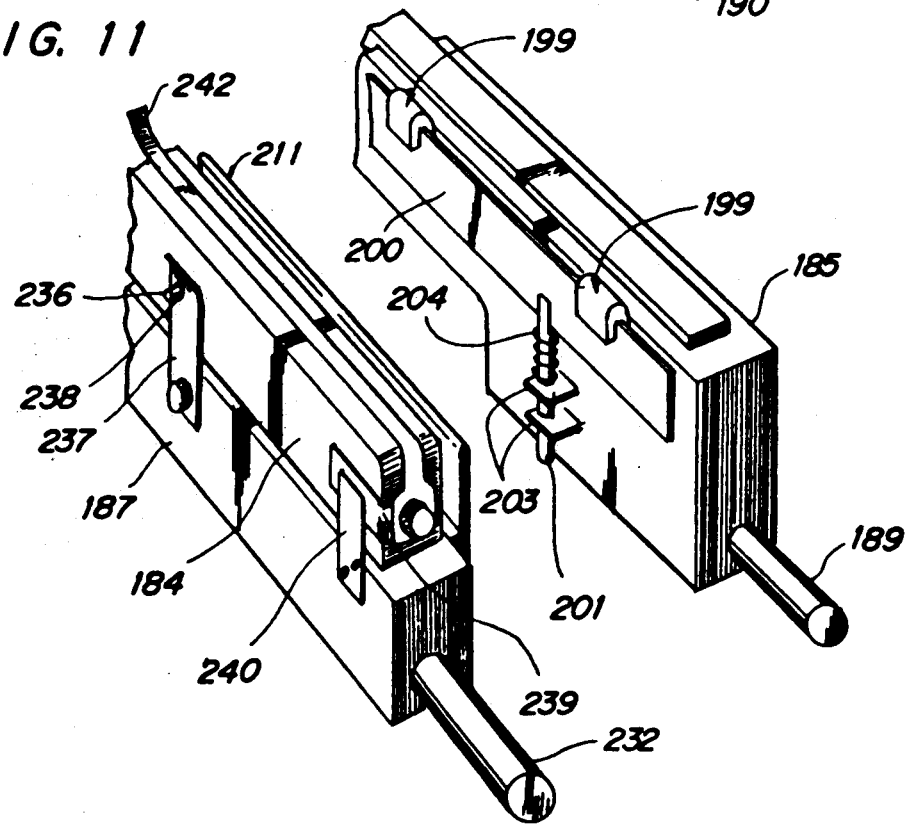
FIG. 11 is a partial perspective view of the seal mechanism.

As FIG. 11 shows, a plate 200 having a plurality of rubber-made grasping members 199, 199 . . . mounted at the front end thereof is disposed on the underside of the seal pad 185, with a bar 201 fixed to the plate 200 which is slidably supported in the holes of two guides 203, 203, the plate 200 being urged forward by a spring 204. Therefore, when the seal pad 185 is laid down horizontally as shown in FIG. 7, the grasping members 199, 199, . . . are pressed against the seal bar 184, with gaps 205, 205 defined between the grasping members 199, 199.

Figure 18:
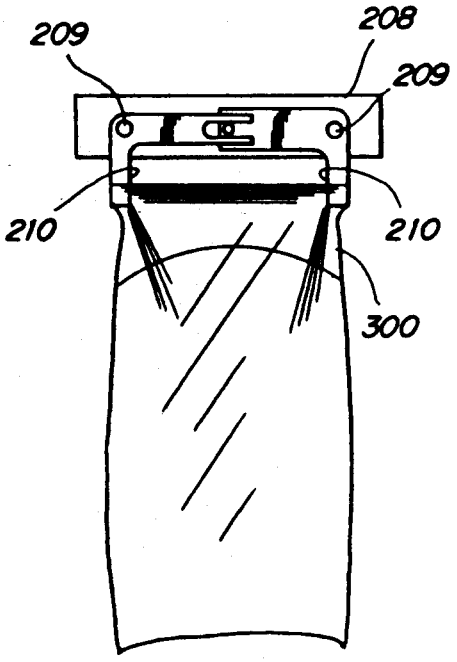
Figure 19:
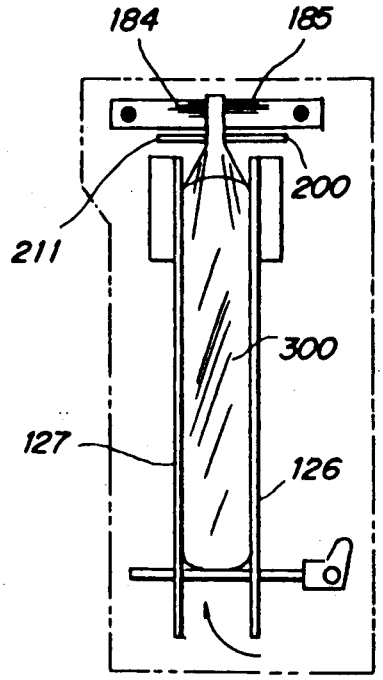

When each chamber 106 in which the bag 300 is filled with an object 182 as FIG. 17 illustrates is again caused to move until it reaches a next stop position, pawls 210, 210 supported on an up and down movement block 208 through shafts 209, 209 are inserted into the bag 300 as FIG. 18 shows, and the mouth of the bag 300 is flatly expanded by the pawls 210, 210 in the lateral directions. Immediately thereafter, as FIG. 19 shows, the seal pad 185 and the seal bar 184 are flatly laid down, the mouth of the bag 300 are flatly supported by the flexible plate 200 and a pedestal 211.

Figure 13:
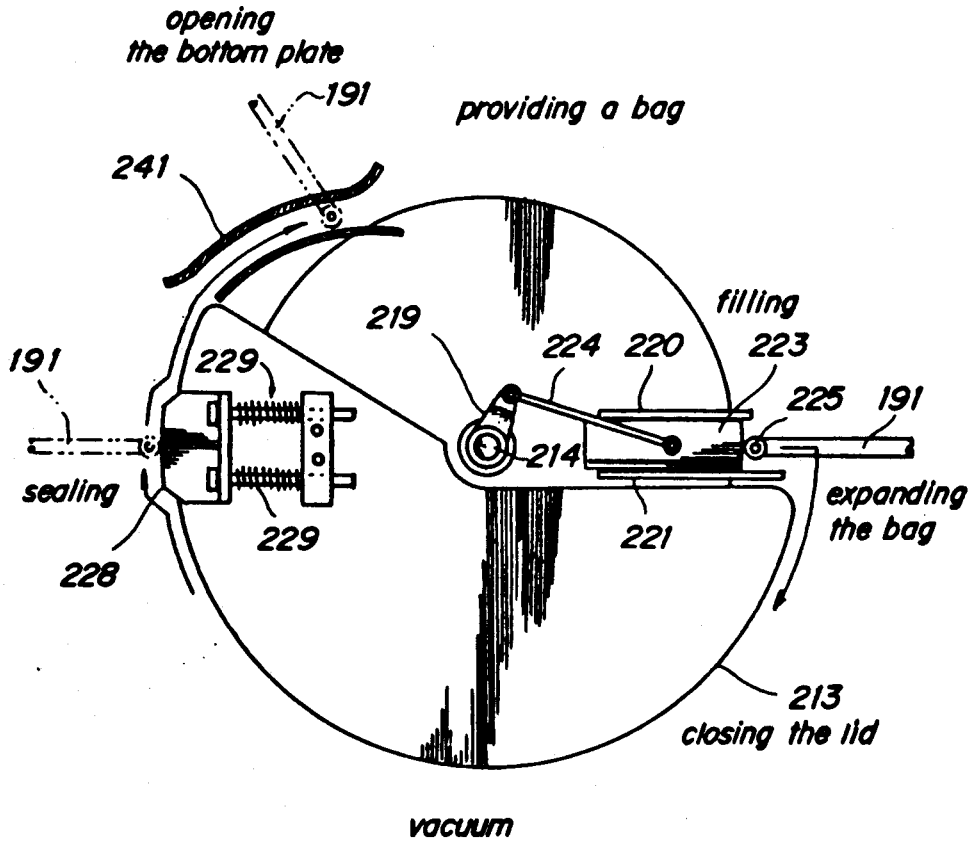
FIG. 13 is a fragmentary plan view showing the vacuum packaging apparatus of FIG. 1.

As FIG. 2 shows, a pipe-made pole 212 fixedly supported at its lower end on the machine frame 100 is mounted in the main shaft 103 of the rotor 104, a cam plate 213 being fixed to the top end of the pole 212, while a shaft rod 214 is rotatably mounted in the interior of the pole 212. A pivotal lever 216 pivotally supported at its base 215 is connected at the front end thereof to a lever 217 fixed to the lower end of the shaft rod 214, the lever 216 being disposed in contact with the periphery of a cam 218 fixed to the driving shaft 111. Therefore, upon each one rotation of the driving shaft 111, the pivotal lever 216 is pivotally moved one time by means of the cam 218, thereby to cause the shaft rod 214 to rotate a predetermined angle about the center of the machine frame. As FIG. 13 shows, a crank arm 219 fixed to the top end of the shaft rod 214 and a hammer 223 mounted slidably within guides 220, 221 are interconnected through a link 224, so that when the shaft rod 214 is rotated within the angular range of up to about 30 degree in the clockwise direction in FIG. 13, the hammer 223 is pushed outward. When the chamber 106 is stopped at a position opposite to the hammer 223 as FIG. 2 shows, the rod 191 is pushed into the chamber 106 by the hammer 223, and therefore the seal pad 185 and seal bar 184 are laid down horizontally. In FIG. 13, as each chamber 106 moves round the cam plate 213, a roller 225 provided at the front end of the rod 191 goes into contact with the cam plate 213, and accordingly the seal pad 185 and seal bar 184 are prevented from their rising up spontaneously.

Soon the lid 115 of the chamber 106 at the top thereof is closed and vacuum is applied to the interior of the chamber 106. More specifically, as FIG. 2 shows, the lower member 108 of the rotary valve 110 is constantly under vacuum through a pipe 226, and as long as the upper arm 105 of the rotor 104 is in communication with the pipe 226, vacuum is applied to the interior of the chamber 106 through the hollow arm 105. Between individual grasping members 199, 199, . . . in FIG. 7 there are gaps 205, 205, . . . through which vacuum is applied to the interior of the bag 300 as well.

As FIG. 13 shows, a sealing cam 228 is disposed on a part of the cam plate 213 in such a way that it is outwardly projectable under the force of a spring 229. When the rod 191 reaches the position of the cam 228, the rod 191 is pushed further ourward by the cam 228. In FIG. 9, therefore, the seal pad 185 is pushed further outward in the direction of arrow 194, and simultaneously an impulse current flows in a heater line 242 in FIG. 11 so that the mouth of the bag 300 is heat sealed.

Figure 12:
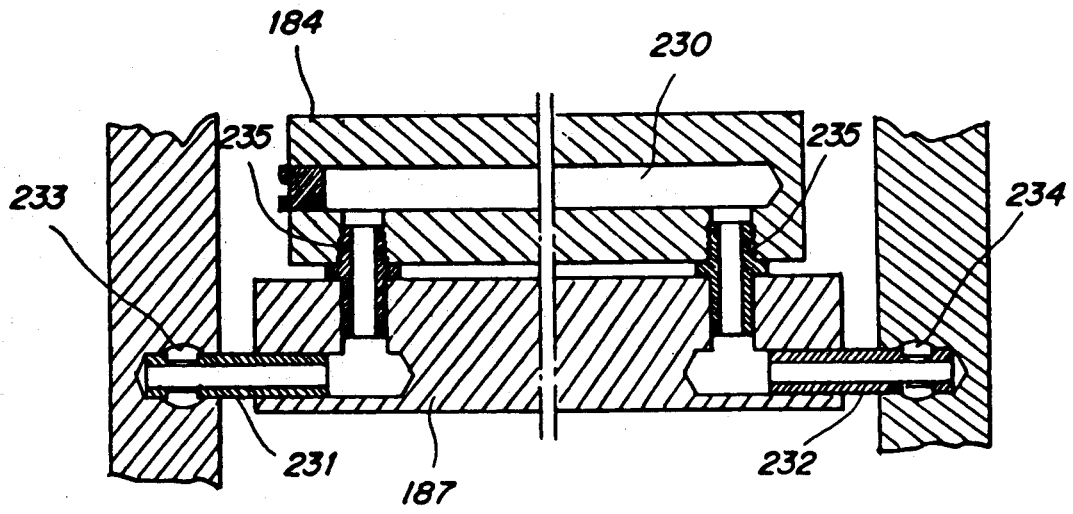
FIG. 12 is a sectional view showing a seal bar in the seal mechanism.

As FIG. 12 shows, in the interior of the seal bar 184 a passage 230 is formed in which cooling water is constantly flowing through shaft members 231, 232 at opposite ends of the base 187 and block holes 233, 234. Therefore, the heat sealed mouth portion of the bag 300 is quickly cooled. The seal bar 184 is inserted at its nozzle portions 235, 235 at both ends thereof into the base 187, and the seal bar 184 is separable at these nozzle portions 235 from the base 187.

As FIG. 11 shows, a pin 236 projecting from the seal bar 184 is held in engagement with a small hole 238 formed in a leaf spring 237 screwed to the base 187, whereby the seal bar 184 is prevented from slipping off the base 187. An end terminal 239 of the heater line 242 is in surface contact with a terminal board 240 provided on the base 187 so as to permit current flow in the heater line 242.

As FIG. 13 shows, behind the sealing cam 228 there extends a groove cam 241 from above to thereby allow the rod 191 to be pulled toward the center of the rotor 104, so that the seal pad 185 and seal bar 184 can rise up in the chamber 106 and simultaneously air flows from the rotary valve 110 into the chamber 106. The bottom plate 117 of the chamber 106 is also simultaneously released, with the result that, as FIG. 20 shows, a vacuum package product 301 is discharged externally from the chamber 106.

Figure 21:
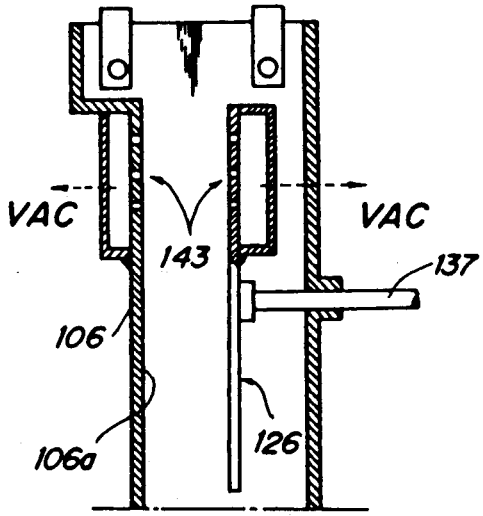
FIG. 21 is a fragmentary sectional view showing another embodiment of the invention.

In place of the two support plates 126, 127 shown in FIG. 3, as FIG. 21 shows, suction holes 143 may be formed on one side wall 106*a* of the chamber 106. In this case, a bag is held under vacuum suction between one support plate 126 moved by the rod 137 and the side wall 106*a*, whereby the bag can be opened at its mouth.

What is claimed is:

1. An apparatus for vacuum packaging objects into bags, comprising:

chambers rotatable along a circular endless track and into which said bags are to be supplied through an opening, drive means disposed in the inside of the circular endless track, a pair of support means disposed in each of said chambers and relatively movable toward and away from each other and which have opposed faces large enough to grasp therebetween a substantial part of one of the bags as the bag is supplied into the chamber, means for mechanically engaging the support means to each other and relatively moving said support means toward and away from each other by means of the power delivered from the drive means, a plurality of suction holes formed on said opposed faces of said pair of support means, suction means for causing a vacuum force of suction to be applied through said suction holes in order to suck opposite sides of the bag when the support means are relatively moved toward each other and open the mouth of the bag when the support means sucking the bag are separated from each other, means for loading the to-be-packaged object into the bag when the mouth thereof is opened, means for closing said opening of said chamber when the bag is filled with said object, means for vacuumizing the chamber when closed, means for heat sealing the mouth of the bag under vacuum, a bottom opening of the chamber and a bottom plate operable to open and close said bottom opening, and means for discharging a vacuum packaged product through the bottom opening from the chamber after the mouth of the bag has been heat sealed.

2. An apparatus as set forth in claim 1, wherein said pair of support means are of plate construction.

3. An apparatus as set forth in claim 1, wherein said first mentioned opening of each of said chambers comprises a top opening, and lid plate operable to open and close said top opening.

4. An apparatus as set forth in claim 3, wherein said top opening is adapted to admit a bag into the chamber and an object into the bag, and said bottom opening is adapted to discharge therethrough and externally from the chamber a packaged product under its own weight.

5. An apparatus as set forth in claim 1, wherein said means for heat sealing the mouth of the bag comprises a seal bar and a seal pad between which the mouth of the bag can be supported in position, wherein said seal bar and said seal pad are movable from an upstanding position to a laid down position and are relatively shiftable so that they are widely spaced from each other when in their upstanding position and closely spaced to each other when in their laid down position, and wherein said heat sealing means has a plurality of grasping members of elastic material disposed on said seal pad which can hold the mouth of the bag in a grasped position in cooperation with said seal bar when said seal pad is pressed against the seal bar forming gaps between the grasping members.

6. An apparatus as set forth in claim 5, wherein the apparatus comprises a plurality of pawls adapted to be inserted into the mouth of a bag prior to the mouth of the bag being held in said grasped position between said grasping members and said seal bar, for flatly extending the mouth of the bag at both sides thereof.

7. An apparatus as set forth in claim 5, wherein the grasping members are attached to a plate and said plate is urged to the seal bar when the seal bar and seal pad are in said closely spaced laid down position.

8. An apparatus as set forth in claim 7, wherein said seal bar has a heater, said seal pad is adapted to be advanced toward said seal bar which is in cooperation with said grasping members in grasping the mouth of the bag, whereby said mouth of the bag can be grasped between said seal paid and said heater, and wherein said heater is able to heat seal said mouth of the bag between said heater and said seal pad.

9. An apparatus as set forth in claim 8, wherein said chamber is formed cylindrically and the reacting force generated by grasping the bag between the seal pad and the seal bar is received by the chamber.

10. An apparatus as set forth in claim 4, wherein the apparatus has means for supporting the bottom of the bag within the chamber.

11. An apparatus as set forth in claim 10, wherein said means for supporting the bottom of the bag coacts with the opening and closing movement of the bottom plate so that said means is positioned at a position for supporting the bottom of the bag, when the bottom plate is closed, and permits a packaged product to be discharged through the lower opening of the chamber while coacting with the bottom plate when the bottom plate is opened.

12. An apparatus as set forth in claim 10, wherein said means for supporting the bottom of the bag is vertically adjustable as to the mounting position thereof.

13. An apparatus as set forth in claim 10, wherein said means for supporting the bottom of the bag comprises a plurality of support rods, and wherein said support means for grasping the bag has gaps to which said support rods are accessible.

* * * * *